US005567174A

United States Patent [19]

Ericson, Jr. et al.

[11] Patent Number: 5,567,174

[45] Date of Patent: Oct. 22, 1996

[54] WATER TIGHT GREASE FILLED CONNECTOR WITH STRAIN RELIEF

[75] Inventors: John E. Ericson, Jr., Gates Mills, Ohio; Eric F. Wilson, Punta Gorda, Fla.; Michael L. Gordzelik, Cookeville, Tenn.; Martin C. Ignasiak, Sarasota, Fla.

[73] Assignee: The Ericson Manufacturing Co., Willoughby, Ohio

[21] Appl. No.: 253,150

[22] Filed: Jun. 2, 1994

[51] Int. Cl.[6] ..... H01R 13/58

[52] U.S. Cl. ..... 439/462; 439/936

[58] Field of Search ..... 439/460, 461, 439/462, 936

[56] References Cited

U.S. PATENT DOCUMENTS

| | | | |
|---|---|---|---|
| 2,014,853 | 9/1935 | Ley et al. . | |
| 2,238,319 | 4/1941 | Goldfield . | |
| 2,901,722 | 8/1959 | Arnott, Jr. . | |
| 3,046,512 | 7/1962 | Remke et al. . | |
| 3,059,210 | 10/1962 | Luenberger . | |
| 3,079,580 | 2/1963 | Paasche . | |
| 3,148,011 | 9/1964 | Brown . | |
| 3,624,591 | 11/1971 | Buberniak | 439/462 |
| 3,646,496 | 2/1972 | Williams | 439/462 |
| 3,895,180 | 7/1975 | Plummer . | |
| 3,905,672 | 9/1975 | Anhalt et al. | 439/461 X |
| 4,010,994 | 3/1977 | Aysta . | |
| 4,030,741 | 6/1977 | Fidrych . | |
| 4,039,742 | 8/1977 | Smith . | |
| 4,040,701 | 8/1977 | Gressit . | |
| 4,090,759 | 5/1978 | Hermann, Jr. . | |
| 4,326,096 | 4/1982 | Leitmann | 439/936 X |
| 4,335,932 | 6/1982 | Hermann, Jr. . | |
| 4,423,732 | 1/1984 | Tarjan et al. | 128/419 P |
| 4,423,918 | 1/1984 | Filreis et al. . | |
| 4,662,692 | 5/1987 | Uken et al. . | |
| 4,665,470 | 5/1987 | George, Jr. | 362/236 |
| 4,820,196 | 4/1989 | Roselle et al. . | |
| 4,938,705 | 7/1990 | Kanno et al. . | |
| 4,993,966 | 2/1991 | Levy . | |
| 4,998,894 | 3/1991 | Gronvall . | |
| 5,083,940 | 1/1992 | Larson et al. . | |

FOREIGN PATENT DOCUMENTS

| | | |
|---|---|---|
| 0272039 | 6/1988 | European Pat. Off. . |
| 040944A2 | 1/1991 | European Pat. Off. . |
| 2165577 | 6/1990 | Japan . |

OTHER PUBLICATIONS

Heyco Molded Products Inc., Heyco Catalog 194, pp. 1–8, 1–9, 1–11, 1–14, 1–15, 1–16, 1–17, 1–18.

*Primary Examiner*—Khiem Nguyen
*Attorney, Agent, or Firm*—Renner, Otto, Boisselle & Sklar, P.L.L.

[57] ABSTRACT

A water tight connector has a strain relief using a circumferential clip about a cable and held in position within a hollow tubular section of a connector housing. The clip is prevented from being removed from the connector housing by a resilient grommet, thus holding the cable from being pulled out from the connector housing; and the grommet provides both fluid sealing functions and secondary cable holding functions. The connector may be filled with a grease. The grease may have anti-bacterial characteristics. The connector may be filled with an hygroscopic material, such as an encapsulant.

30 Claims, 4 Drawing Sheets

WATER TIGHT GREASE FILLED CONNECTOR WITH STRAIN RELIEF

TECHNICAL FIELD

The invention relates generally, as is indicated, to connectors for cables, and, more particularly, to water tight greased filled connectors with strain relief.

The invention is described in detail below with reference to an electrical connector for an electrical cable. The cable may carry various signals, whether of low voltage level such as information, data, etc. signals, higher voltage level signals for providing electrical power, and/or other types of signals. However, it will be appreciated that the various features of the invention may be used with other types of connectors, such as those used with optical cables and/or other types of cables.

BACKGROUND OF INVENTION

In a typical electrical connector (sometimes referred to in the art as a cable termination or when assembled with a cable as a cable termination assembly) the cable conductors are terminated by connection to the respective electrical contacts that are located at least partly in a housing. When the connector is a female connector type, the contacts usually are fully within the connector housing and are intended to receive male contacts, such as blades, pins, etc., that are placed into mechanical and electrical engagement/connection therewith. In a male connector usually portions of the male contacts extend outside the connector housing exposed for insertion into the female connector housing for mechanical and electrical connection with respective female contacts. The electrical cable may have one or more conductors contained in separate, shared or both electrical insulating material, and usually each conductor is terminated by connection to a respective contact in the connector housing. The actual conductor size, e.g., diameter, conductivity, resistivity, current and/or voltage capacity, etc., and the corresponding size of the contacts usually is a function of the magnitude of the signal(s) intended to be carried. The size of the connector housing also usually is proportional to the cable and contact sizes and the desired power capacity of the connector. Exemplary connectors for industrial machinery and equipment often are sized to carry 15, 20, or 30 amperes; the invention may be used with larger or smaller connectors and cables.

When an electrical connector is intended for use in wet environments, hazardous environments, etc, it is desirable that the electrical connector be water tight. In a water tight electrical connector various means are used to prevent water and/or other liquids from too easily entering the connector housing where connections are made between contacts and cable conductors. It also is desirable in some circumstances to prevent water from entering the space between two connectors that are connected, e.g., plugged, together. Various sealing mechanisms have been used for these purposes in the past.

In some prior electrical connectors, various media have been placed in the connector housing to prevent arcing, to avoid corrosion, and to facilitate sliding of contacts into and out of engagement with each other. A problem with a fluid medium, such as grease, in the connector housing, has been the inability conveniently to replenish the medium when and if some has leaked from the connector housing. Other problems with electrical connectors that have had grease-type medium in the connector housing have been the difficulty of securely retaining the cable in attachment to the connector housing to prevent relative movement of the cable and connector housing due to the lubricated environment, the prevention of mechanical stress being applied to the contacts and their engagements or connections to the cable conductor in that connector housing, the blocking of leakage of the medium (as was mentioned above), and the avoiding of damage to the cable by bending over too sharp a bend where the cable exits the connector housing.

In the food processing industry and/or in other industries where it is necessary to wash equipment relatively frequently for cleanliness, it is important to assure that the electrical connectors used in such environments can withstand the frequent washing without being damaged by moisture. A problem in such environments is the accumulation of bacteria, the washing being intended to minimize such accumulation. However, within an electrical connector in which moisture possibly may enter, there frequently is a relatively warm environment, especially when electric current is being carded, and such a local environment, which is relatively inaccessible for washing, may provide a haven for growth and accumulation of bacteria.

Various features of the present invention help to overcome respective ones of the aforementioned problems encountered in prior electrical connector systems.

BRIEF SUMMARY

Briefly, according to one aspect of the present invention, an apparatus for holding an elongate member such as a cable, relative to a device, such as a connector, includes a restraining mechanism for circumscribing at least a portion of the elongate member, the restraining mechanism engaging the elongate member to prevent relative axial movement of the restraining mechanism and elongate member, a receiving mechanism positionally associated with the device to receive therein at least a part of the restraining mechanism and at least a part of the elongate member, the receiving mechanism including a wall for preventing such loosening of the restraining mechanism relative to the elongate member that would permit substantial relative axial movement, and a holding mechanism to block withdrawal of the restraining mechanism from the receiving mechanism in at least one direction.

According to another aspect, an electrical assembly includes a housing, an opening into the housing, a cable positioned relative to the housing and with at least part of the cable being at least partly located in the opening, and a retention mechanism for retaining the cable relative to the housing, the retention mechanism including a clip for deforming part of the cable to grasp the cable, a grommet for frictionally engaging the cable to prevent relative movement of the cable and the grommet, and a holding mechanism to hold the grommet in at least part of the opening while the grommet frictionally holds the cable, the grommet being located between the clip and at least part of the holding mechanism.

According to another aspect of the invention, a connector includes a housing, a signal conducting device at least partly in the housing for making connections, and grease in the housing for resisting growth of bacteria.

Still another aspect of the invention relates to a method of reducing growth of bacteria in a connector that includes a housing and a signal conducting device at least partly in the housing, the method including placing an anti-bacterial material in the housing with at least some of the material in proximity to at least part of the signal conducting means.

Another aspect relates to the use of an encapsulant material in a connector to reduce the accumulation of moisture and/or moisture related effects, such as bacteria accumulation, corrosion, shorting, etc.

Another aspect is to provide such an encapsulant that would be acceptable for use in the food processing industry, e.g., having non-toxic properties.

According to yet another aspect of the invention, a connector includes a housing, a signal conducting means at least partly in the housing for making connections, and a port for providing access to the interior of the housing to permit the delivery of fluidic material into the housing.

These and other features, embodiments, objects and advantages of the present invention will become more apparent as the following description proceeds.

It will be appreciated that although the invention is described with respect to preferred embodiments that are illustrated in the drawings, the scope of the invention is to be limited only by the scope of the claims and equivalents thereof.

To the accomplishment of the foregoing and related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be employed.

DETAILED DESCRIPTION

Figure 1:
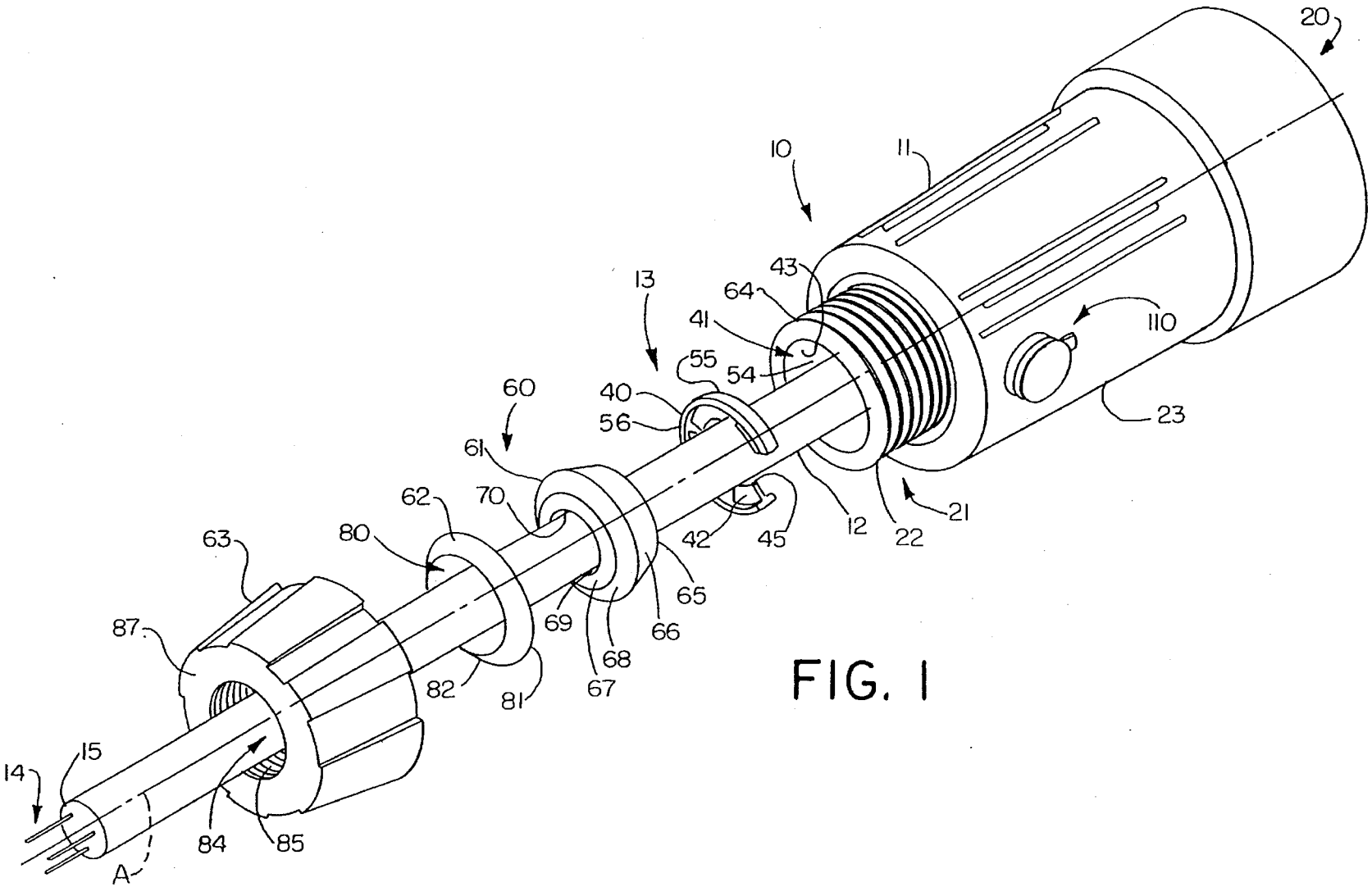
FIG. 1 is an exploded isometric view of a cable termination assembly, also referred to herein as a connector assembly, in accordance with the present invention showing the greased port closed.
Figure 2:
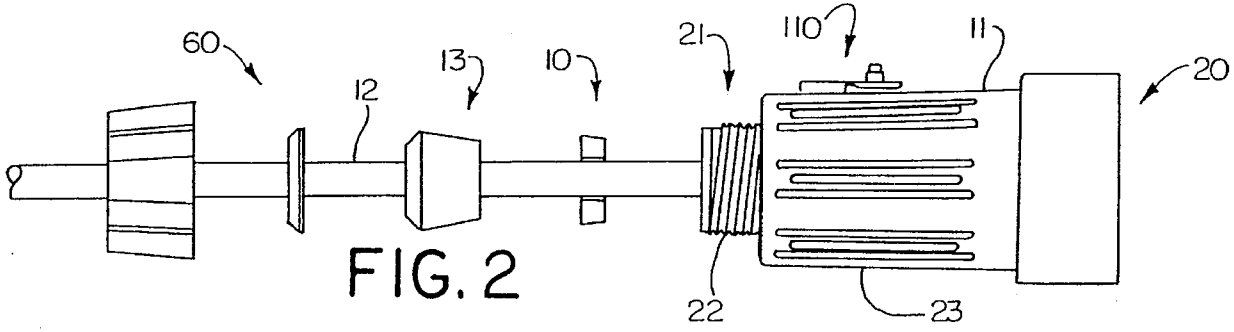
FIG. 2 is ant exploded plan view, partly in section, of the cable assembly of FIG. 1 showing the grease port open.
Figure 4B:
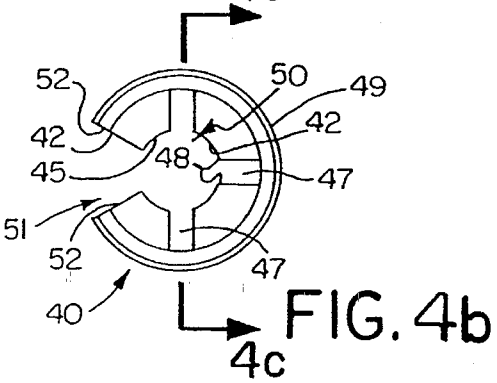
FIG. 4*b* is a plan view of the cable restraint clip.
Figure 4A:
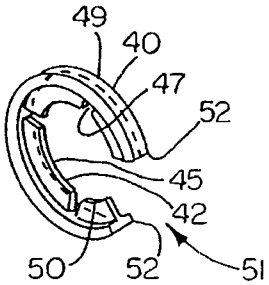
FIG. 4*a* is an isometric view of a cable restraint clip of the connector assembly.
Figure 4C:
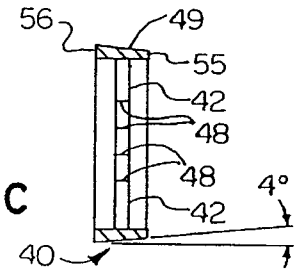
FIG. 4*c* is a side elevation section view of the cable restraint clip looking generally in the direction of the arrows 4*c*—4*c* of FIG. 4*b;*

Referring, now, in detail to the drawings, wherein like references numerals designate like parts in the several figures, and initially to FIGS. 1 and 2, a connector assembly in accordance with the present invention is generally shown at 10. The connector assembly includes a female connector housing 11, an electrical cable 12, electrical contacts (not shown) in the housing, and a cable holding mechanism 13 (which is sometimes referred to as a strain relief or a cable gripping mechanism, etc.), for holding the cable 12 relative to the connector housing 11. The purpose of the cable holding mechanism 13 is to prevent the cable 12 from being withdrawn from the connector housing 11 and preferably to prevent mechanical stress from being applied to the connections between respective cable conductors 14 (three of which are shown in FIG. 1) and contacts (not shown), especially when a force is applied to the cable 12 tending to pull it out from the connector housing 11 (e.g., to the left relative to the illustrations of FIGS. 1 and 2).

Figure 14:
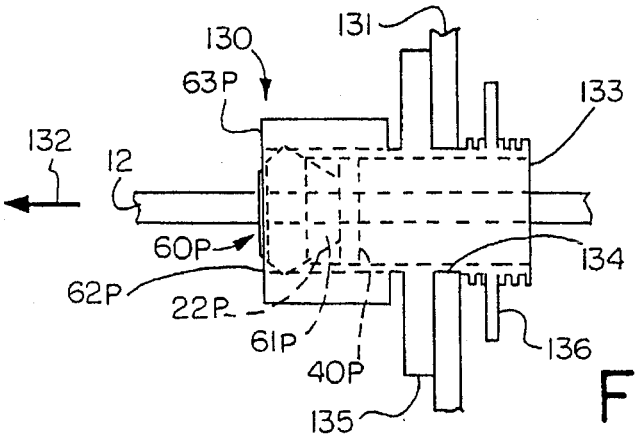
FIG. 14 is a schematic section view of a cable holding mechanism of the invention coupled to a plate or box type structure.

It will be appreciated that although the cable 12 is described herein as an electrical cable having one or more conductors 14 in electrical insulation 15, the invention may be used with optical cable in which case the cable 12 is optically conductive and/or contains one or more fiber optic members for carrying optical signals therein. Also, it will be appreciated that features of the invention, especially the cable holding mechanism 13, may be used not only with connector assemblies 10 in which electrical connections are intended to be made, but also with other types of electrical devices, such as junction boxes, wall plates, splice boxes, etc. An example of the use of cable holding mechanism 13 with a face plate of an electrical box, such as a junction box, is illustrated in FIG. 14. Thus, the cable holding mechanism 13 and other features of the invention described herein may be used with connector assemblies, electrical boxes, plates, etc. as will become evident from the description and drawings.

Figure 3:
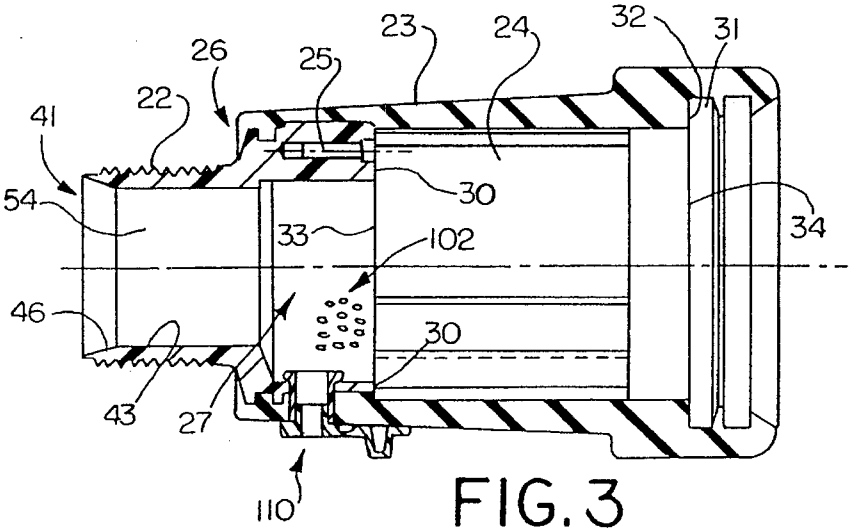
FIG. 3 is a section view of a female connector housing of the connector assembly of FIG. 1.

The connector housing 11, which is seen in FIGS. 1, 2 and 3, preferably is made of a molded polymeric, rubber, or other material that preferably is electrically nonconductive. The connector housing 11 has a front connecting end 20 that is exposed for insertion therein of male contacts, and a back strain relief 21 into which the cable 12 is inserted. In the illustrated embodiment, the housing 11 is formed primarily in three parts, namely a coupling part 22, a cover part 23, and a contact carrier module 24. The contact carrier module is mounted in the cover part 23 and preferably is secured to the coupling part 22, for example, by screws or other fasteners (not shown) attached to screw holes 25. The cover part 23 may be over molded or insert molded onto the coupling part 22, the two being connected in the manner shown generally at 26 in FIG. 3. Alternatively, the cover part 23 may be of relatively resilient material that can be slid over and resiliently snapped onto the coupling part 22 securing to various indent and flange portions of the coupling part. The cover part 23 preferably has a hollow interior portion 27 in which the contact carrier module 24 is located.

In assembling the connector assembly 10, initially the contact carrier module 24 is positioned outside the front connecting end 20 of the connector housing 11. Several portions of the cable holding mechanism 13 are slipped over the cable 12, and the front end of the cable then is inserted through the back end 21 of the connector housing 11 and is positioned so that the conductors 14 at the front end are exposed beyond the front connecting end 20 of the connector housing 11. The exposed front end conductors then are attached to respective contacts of the contact carrier module 24, for example, by screws or other fasteners; and the contact carrier module 24 then is pushed into the front end 20 of the connector housing 11 into the hollow interior 27 against seat 30 of the coupling part 22. Screw fasteners then are inserted through the contact carrier module 24 and are tightened in the screw holes 25 securing the contact carrier module in the connector housing.

The contact carrier module 24 has a flange 31 which is pulled tight against a seat 32 when the screws are tightened into the screw holes 25. The engagement of the flange 31 with the seat 32 and of the back end 33 of the contact carrier module 24 with the seat 30 provide a seal to tend to prevent moisture from entering the hollow interior 27 of the connector housing 11 from the front 20 on the back 21. The contact carrier module 24 also includes means to provide exposure to contacts therein from the front end 34 (also see FIG. 8) at the front connecting end 20 of the connector housing 11 while providing internally of the contact carrier module sealing means of conventional design to prevent moisture from permeating through the contact carrier module to the back end 33 into the hollow interior 27 of the connector housing 11. An exemplary contact carrier module having these characteristics is included in the connector assemblies sold by Ericson Manufacturing Company under Model No. 2310-PW and 2410-CW, for example.

Referring to FIGS. 1–6, the cable holding mechanism 13 is described. The cable holding mechanism includes a restraining clip or ring 40. The clip 40 is placed over the cable 12 in generally circumscribing relation to be generally axially concentric with the cable. The clip 40 is received in an opening 41 in the coupling part 22 of the connector housing 11. The clip 40 has plural segments 42 that are intended to press into the cable 12 preferably without piercing the cable insulation 15 but preferably also somewhat deforming the insulation to provide a secure gripping of the cable to prevent relative movement, especially axial movement, of the clip and the cable. The cable axis, which is shown not only through the cable itself but also through the connector assembly 10, is represented by a phantom line designated A. The segments 42 of the clip 40 preferably are relatively smooth and dull (as opposed to sharp) to avoid piercing or breaking the insulation 15 when the clip is compressed. The clip 40 not only is received in the opening 41 of the coupling part 22 but also preferably is cooperative with the interior wall 43 of the coupling part whereby the wall 43 prevents the clip 40 from releasing the aforesaid secure engagement with the cable 12. Preferably the clip 40 is resilient so that it can be squeezed against the cable 12 to urge the inner edges 45 of the respective segments into deforming engagement with the cable insulation 15. The diameter of the opening 41 where the wall 43 of the coupling part 22 cooperates with the ring is such that expansion of the clip 40 that would release the segments 42 from secure deforming engagement with the cable is prevented. As is seen in FIG. 3, the wall 43 may have a tapered edge 46 to squeeze the clip 40 into engagement with the cable as the clip and part of the cable are urged into the opening 41. Additional interior portions of the wall 43 also may be tapered so that the clip 40 tends to close more securely against the cable 12 as the clip 40 is urged further into the coupling part 22.

The clip 40 may be made of a plastic, polymer, rubber, metal, or other material that is pliable allowing it to be deformed to compress into secure engagement with the cable. For example, the clip may be a molded plastic material. The segments 42 preferably are general arcuate and are separated from each other by spaces 47. The size of the spaces 47 between respective relatively adjacent segments 42 is adequately large so that adjacent segments ordinarily do not engage each other when the clip 40 is compressed. Therefore, the comer edges 48 of the segments will not pinch the cable insulation so as to tend to avoid tearing or destroying the integrity of the cable insulation. Furthermore, preferably the spaces 47 are adequately large so that as the clip 40 is compressed about the cable insulation, portions of the insulation 15 will be deformed or in a sense extruded into the spaces between respective adjacent segments 42.

The segments 42 are mounted on a ring-like support 49. The support 49 preferably is of generally a circular annular shape having a central open area 50 into which the cable is located and an access way 51 leading into the open area 50. Since the clip 40, and especially the support 49, preferably is resilient, the edges 52 can be spread apart to enlarge the access way 51 to insert the clip over the cable, if desired. Alternatively, an end of the cable can be inserted into the open area 50 and the clip can be slid along the cable to an appropriate axial location proximate the connector housing 11. Preferably the axial thickness of the segments 42, i.e., along the direction of the axis A when used in the connector assembly 10, is relatively small to facilitate a deforming of the cable insulation 15 with relatively minimal resistance from the cable, but sufficiently large to provide adequate strength and rigidity to the segments. The axial thickness of the support 49, i.e., in the direction of the axis A when in use in the connector assembly 10, is adequately long to provide secure support for the segments 42 ordinarily without the clip breaking or deforming beyond its elastic limit. The axial length of the support 49 also preferably is adequately long to cooperate with the wall 43 of the coupling part 22 to provide substantially uniform distribution of forces therebetween and also to tend to prevent the clip from slipping out of the plane that is generally perpendicular to the axis A as the clip is inserted into the opening 41 and is retained therein. Still further, the wall 53 of the support 49 of the clip 40 preferably is tapered to facilitate interaction with the wall 43 in the interior 54 of the coupling part urging the clip closed against the cable as the clip is slid into the coupling part; in such case, the external diameter of the clip 40 at the leading edge or front edge 55 thereof is smaller than the external diameter of the trailing edge or back edge 56 thereof.

In addition to the clip 40 and the opening 41 and interior wall 43 of the coupling part 22, the cable holding mechanism 13 includes a holder 60 which holds the clip 40 in the interior 54 of the coupling part 22.

The holder 60 blocks withdrawal of the clip 40 from the coupling part 22 of the connector housing 11 from the back end 21. By preventing the clip 40 from withdrawal from the interior 53, and since the clip 40 is restrained against axial movement on the cable 12 while the clip is in the interior 53, the cable accordingly is held securely to the connector housing 11 to complete the connector assembly 10.

An advantage to the invention employing the clip 40 in the coupling part 22 of the connector housing 11 is that the forces which bend the cable outside of the connector assembly 10 tend not to be transmitted to the clip 40 or to the area of the cable where it is engaged with the clip. Therefore, the amount of deformation of the cable insulation 15 caused by the clip 40 tends not to change. Also, bending of the cable 12 externally of the connector assembly 10 will not damage the cable at the area of the clip 40, and the force or strength with which the cable holding mechanism 13 holds the cable to the connector housing 11 remains substantially constant.

The holder 60 may take various forms. According to the preferred embodiment of the invention, the holder 60 provides a function of holding the clip 40 in position in the coupling part 22, sealing the hollow interior 27 of the connector housing 11 in relatively fluid tight manner, and supplementally holding the cable 12 in position relative to the connector housing 11.

The holder 60 includes a grommet 61, a ferrule 62, and a fastener 63, such as an internally threaded nut. The grommet, ferrule and nut cooperate to hold the clip 40 in the interior 53 of the coupling part 22 preventing removal or withdrawal of the clip. With the clip secured in substantially fixed axial position in the cable and precluded from being pulled from the housing 11 out the back end 21, the cable thus is held relative to the housing and cannot ordinarily be pulled out from the back end. Since the cable cannot move axially backward relative to the housing 11, the application of force tending to pull the cable out from the back end will not be transmitted to connections between the cable and contacts in the housing 11. Preferably, too, the grommet, ferrule and nut cooperate initially to urge the clip 40 into the opening 41 and interior 54*u* of the coupling part 22 as the nut 63 is tightened on the external thread 64 of the coupling part.

With the foregoing in mind, then, the grommet 61 preferably is a resilient polymeric, rubber, etc., material that has a double tapered truncated conical exterior shape. The grommet has a front or leading edge surface 65, a forward or leading truncated conical exterior surface 66, a back or trailing surface 67, and a rearward or trailing truncated conical surface 68. The grommet 61 also has a hollow interior passage 69 bounded by a generally cylindrical wall 70. The front surface 65 is intended to engage the clip 40 to urge the clip into the opening 41 of the coupling part 22. Preferably the surface 65 also continues to remain in engagement with the clip 40 while the clip 40 is in the interior 54 of the coupling part 22 to prevent tilting of the clip relative to a plane perpendicular to the axis A.

The truncated conical surface 66 of the grommet 61 is tapered to have a smaller diameter at the front surface 65 and a larger diameter adjacent the surface 68. Moreover, the approximate angle of taper of the surface 66 is about the same as the angle of taper of the edge 46 of the wall 43 leading into the coupling part interior. This relatively close relationship or identity of angular relationship of the surface 66 and the edge 46 helps to assure that when the grommet 61 is urged by the nut 63 securely into the opening 41, a substantially fluid light seal is provided between the grommet surface 66 and the coupling part edge 46. The angular taper of the edge 46 and the diameter of the grommet 61 along the surface 66 are related so that as the nut 63 is tightened on the thread 64 the grommet also is squeezed against the cable 12 securing the cable in the interior passage 69 of the grommet by engagement of the cable with the grommet wall 70. Moreover, with the nut 63 tightened securely on the thread 64 of the coupling part 22, the wall 70 presses securely against the cable 12 also to provide a substantially fluid tight seal therebetween.

As was mentioned above, preferably the segments 42 of the clip 40 tend to deform part of the cable insulation 15 causing that insulation to enter the spaces 47. Since the grommet wall 70 is urged into close or preferably light engagement with the cable insulation, the deformed insulation in the spaces 47 will not be able to pass into the grommet interior opening 69. Thus, the grommet 61 and clip 40 cooperate to provide a further securing of the cable 12 to the connector housing 11.

Figure 8:
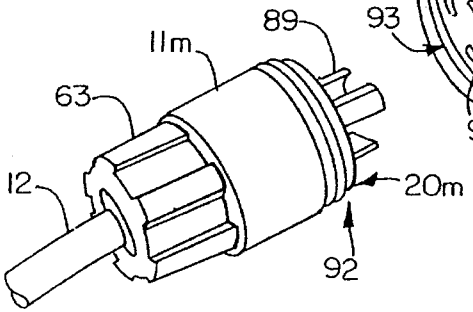
FIG. 8 is an exploded isometric view of a male connector assembly and a female connector assembly, both according to the invention, generally aligned for interconnection with each other to connect a three-wire electrical system.

The ferrule 62 is of truncated conical shape having a circular opening 80 therethrough, a front surface 81, and a back surface 82. The ferrule may be formed of metal or other relatively rigid material. The front surface 81 is oriented at an angle that is approximately the same as the tapered angled of the back surface 68 of the grommet 61 to fit in generally surface to surface engagement with the truncated conical surface 68 of the grommet. Also, the smallest inner diameter of the opening 80 of the ferrule 62 adjacent the edge 83 preferably is slightly smaller than the largest outer diameter of the annular generally planer back surface 67 of the grommet 61 so as to overlap at least slightly such back surface. With the ferrule 62 so configured relative to the grommet 61, as the nut 63 is tightened on the thread 64 to urge the ferrule against the grommet and thus to urge the grommet into the opening 41 of the coupling part 22 of the connector housing 11, the ferrule tends to distribute force over the surface 68 of the grommet and also holds the grommet surface 67 in a somewhat compressed relation preventing expansion of the grommet at the back surface 68. Therefore, as is seen in FIG. 8, the grommet does not tend to extrude through the opening 80 and through the nut 63 as the nut is tightened. By preventing such extruding type of action, the grommet does not tend to loosen its hold on the cable or its water tight seal with the cable 12 or coupling part 22 as the nut is tightened.

The nut 63 preferably is a relatively rigid material, such as plastic, a polymer, a metal, etc. The nut 63 has a passage 84 therethrough, and the cable 12 is intended to extend through that passage. The interior of the passage has a thread 85 formed therein to cooperate with the thread 64 on the coupling part 22 so that the nut can be tightened or loosened relative to the connector housing 11.

Figure 6:
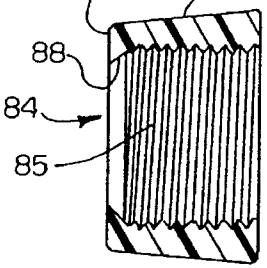
FIG. 6 is a section view of a threaded nut fastener of the connector assembly.
Figure 5:
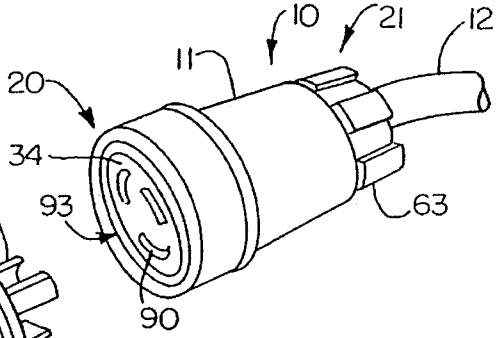
FIG. 5 is a section view of a ferrule of the connector assembly.
Figure 5:
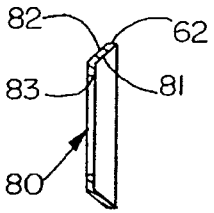

The opening 86 at the back end 87 of the nut 63 has a tapered surface 88 (seen in FIG. 6). The surface 88 preferably has the same or approximately the same angle of taper as the angle of taper of the back surface 82 of the ferrule 62. The surfaces 88 and 82 preferably meet in face-to-face abutment as the nut 63 is tightened thereby to distribute the force from the nut substantially uniformly over the ferrule and, thus, substantially uniformly to transmit such force to the grommet 61 and clip 40. By having a relatively large surface area of engagement between the surfaces 88 and 82, highly concentrated point sources of force are minimized, and the nut 63 can be tightened relatively easily by hand onto the thread 64 of the coupling part 22 to urge at least part of the clip 40, preferably all of it, and at least part of the grommet 61 into the coupling part of the connector housing 11. Such tightening preferably can be completed entirely by hand without the need of special tools, torquing instruments and/or measuring apparatus. Manual tightening of the nut 63 results in the securing of the cable to the connector housing 11 as a strain relief mechanism and also provides a fluid tight seal both between the grommet 61 and the connector part 22 and between the grommet 61 and the cable insulation 12. Since the clip 40 is located partly or fully within the interior 54 of the coupling part 22, since the main holding forces to retain the cable 12 to the connector housing 11 are provided by the clip 40 and secondarily by the grommet 61, and, additionally, since the location at which the cable exits the cable holding mechanism 13 is at the grommet, which preferably is resilient, the cable may be relatively smoothly bent right outside the connector 10, if desired, in part relying on the resiliency of the grommet, without detrimentally affecting the cable insulation and the secure holding of the cable to the connector housing.

Figure 7:
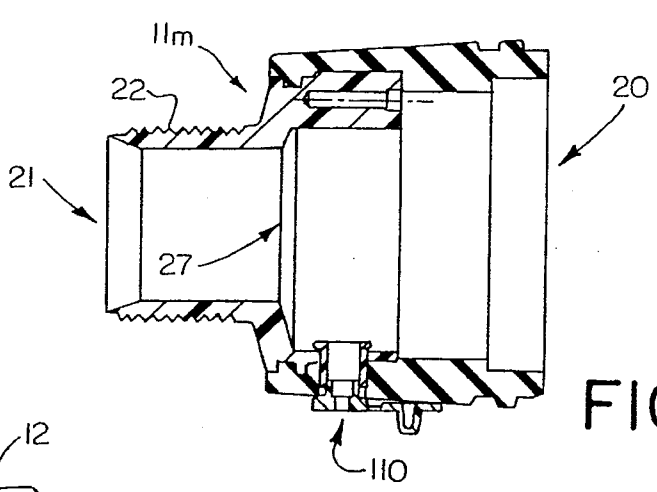
FIG. 7 is a side elevation section view of a male connector housing for a connector assembly according to the present invention.

Briefly referring to FIG. 7, a side elevation section view of a male type connector housing 11*m* is illustrated. In FIG. 7 various portions of the male connector housing 11*m* which correspond to similar portions in the female connector housing 11 described above with respect to FIGS. 1–3, are identified by the same reference numeral with the suffix "m". The connector housing 11*m* is used with a contact carrier module (not shown) that contains male contacts 89 (FIG. 8). The axial length of the connector housing 11*m* is shorter than the axial length of the connector housing 11 (FIGS. 3 and 4) since the connecting portions of the contacts for a male connector usually protrude beyond the connector housing, and, therefore, space for such connecting portions does not have to be provided in the male connector housing 11*m*. The various other portions of the connector housing 11*m* are substantially the same as the various portions of the connector housing 11 described above with respect to FIGS. 1–3. The cable holding mechanism associated with the connector housing 11*m* to make a male connector assembly are identical to those described above with reference to FIGS. 1–3.

Briefly referring to FIG. 8, a female connector assembly 10 and a male connector assembly 10*m*, which employs the connector housing 11*m* mentioned above with respect to FIG. 7, are illustrated. Openings 90 in the front face of the contact carrier module 24 in the connector assembly 10 provide access to female contacts within the connector housing 11. The male connector assembly 10*m* has a plurality of male contacts in the form of spade-like contacts 89 which are aligned and arranged in the pattern to fit into respective openings 90 to connect mechanically and electrically with the female contacts in the female connector assembly 10. A number of inter-fitting flanges and recesses 92 near the front end 20*m* of the male connector housing 11*m* and 93 at the front end 20 of the female connector housing 11 preferably inter-engage when the two connector assemblies are secured together to provide a substantially fluid tight seal therebetween preventing moisture and/or other material from entering the sealed area.

Figure 10:
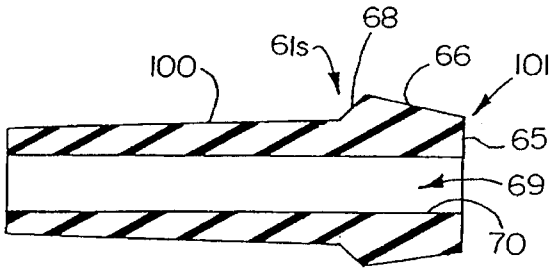
FIG. 10 is a section view of the strain relief boot.
Figure 9:
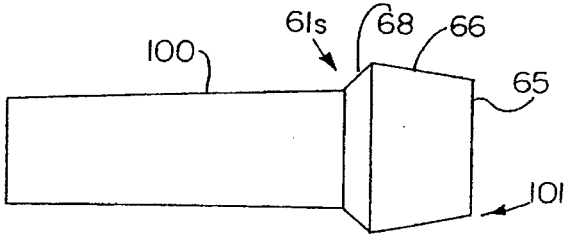
FIG. 9 is an elevation view of a flexible strain relief boot for use in an alternate embodiment of connector assembly according to the invention.
Figure 11:
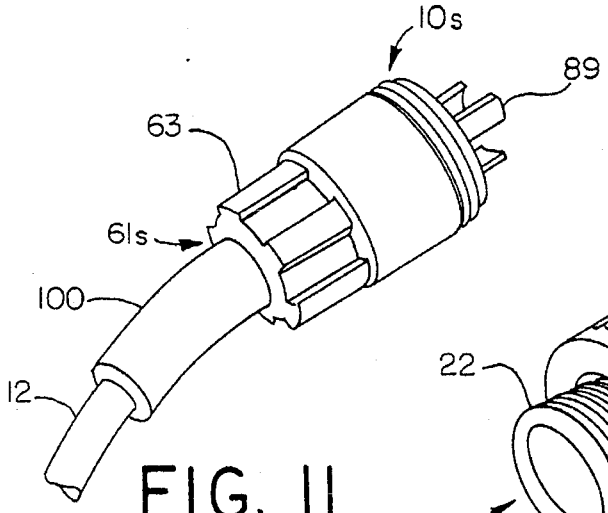
FIG. 11 is an isometric view of a male connector assembly employing a strain relief boot in accordance with the alternate embodiment of the invention.

In some instances it is desirable to control the sharpness that a cable 12 can bend where it exits the connector housing of a connector assembly. With reference to FIGS. 9–11, a boot 100 which limits the sharpness of such bending, is illustrated. The boot 100 is part of an alternate form of grommet 61*s*, such boot being shown in FIG. 11 employed in a connector assembly 10*s*.

As is shown in FIGS. 9 and 10, the alternate or modified grommet 61*s* includes a forward portion 101 that is substantially the same as the grommet 61 including surfaces 65, 66 and 68, and an open interior 69 bounded by a wall 70. The forward portion 101 of the modified grommet 61*s* functions identically to the grommet 61 in the cable holding mechanism 13 described about with reference to FIGS. 1–3. However, the modified grommet 61*s* also includes a boot portion 100 preferably in the form of an elongate hollow annular cylinder. The boot portion 100 and forward grommet portion 101 preferably are made of resilient flexible material, such as rubber, plastic, polymer, etc. The modified grommet 61*s* can be molded as a single part or may be otherwise formed. The opening 69 and the wall 70 preferably extend the entire axial length of the modified grommet 61*s*.

Construction, assembly, and use of the connector assembly 10*s* (FIG. 11) employing the modified grommet 61*s* is substantially the same as that described above with respect to the connector assembly 10 of FIGS. 1–3. However, when the modified grommet 61*s* is inserted onto the cable 12, the cable is inserted fully through the boot 100 as well as the forward portion 101. The forward portion 101 functions as the grommet 61 does in the manner described above. The boot 100, however, provides a flexible support for the cable where the cable exits the nut 63 of the connector assembly 10*s* to provide support for the cable and also to limit the sharpness with which the cable can be bent relative to the connector assembly 10*s*.

In some instances it is desirable to provide in the connector housing of a connector assembly grease or other fluid material. According to an embodiment of the present invention it is desirable substantially to fill the open space available in the hollow interior 27 with grease after the connector assembly has been fully assembled in the above-described manner. Some of the grease 102 is schematically shown at 102 in FIG. 3. It also is desirable to be able to refill grease in the connector assembly in case grease has leaked out and/or in case the connector assembly has been partly or fully disassembled and then reassembled. The sealing functions of the contact carrier modules 24 in the female and male connector housings are of conventional form; also, as was described above, the contact carrier modules are secured against respective seats in the respective connector housings in fluid tight relation to prevent entry of moisture and/or other contaminants; and such seal functions also retain the grease 102 within the connector housing 11, 11*m*. Moreover, the seal function provided by the grommet 61 or modified grommet 61*s* relative to the wall 43 and/or edge 46 of the coupling part 22 of the connector housing 11 (or 11*m*) and also with respect to the cable 12 which passes through the interior opening 69 of the grommet, prevents leakage of the grease 102 at the cable holding mechanism 13. The secure holding function provided by the cable holding mechanism 13 helps to assure that the cable is retained relative to the connector housing 11, 11*m* even though a relatively lubricated environment may exist due to the grease.

Figure 12:
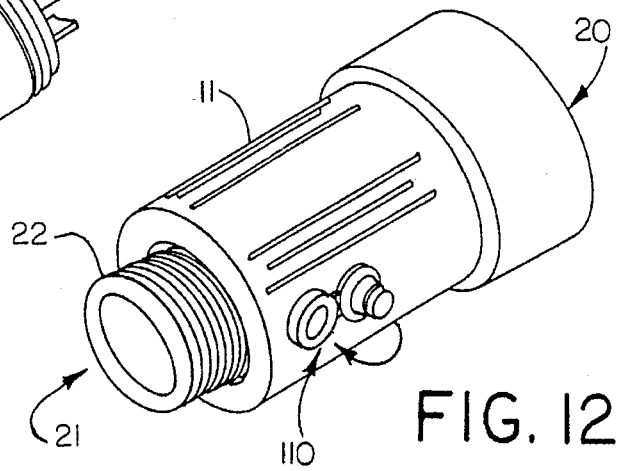
FIG. 12 is an isometric view of a female connector housing showing the grease port in open condition.
Figure 13:
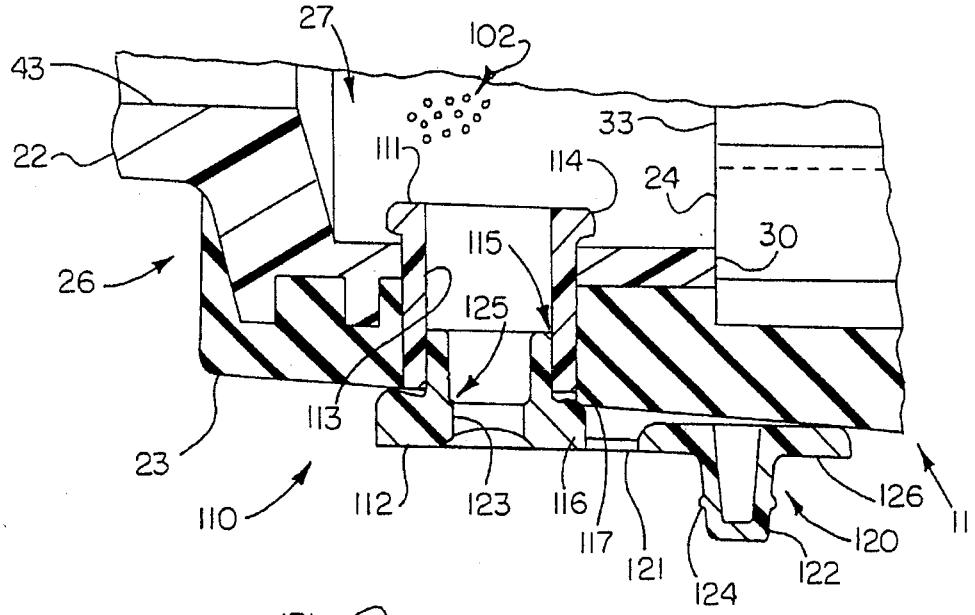
FIG. 13 is an enlarged section view of the grease port in the female connector housing of FIG. 12.

A grease port 110 for providing access to the interior 27 of the connector housing 11 to permit the deliver of material (such as grease 102) into the connector housing is shown in enlarged view in FIG. 13. In FIGS. 12 and 13 the port 110 is shown open, as it also is shown in FIGS. 2, 3 and 7, and in FIG. 1 the port 110 is shown closed. The port 110 preferably is used to permit the delivery of grease, described in detail below, into the interior 27 of the female connector housing 11 or of the male connector housing 11*m* (FIG. 7, for example). However, other materials also may be delivered into the housing using the port. Further, the release of air from the interior 27 when the grease is delivered into the housing can be via the port 110 or via minor leakage at other parts of the overall connector assembly, e.g., at the various seals, through portions of the contact carrier module 24, etc.

The grease port 110 is formed of a hollow cylindrical female fitting 111 and a hollow cylindrical male fitting 112. The female fitting is inserted in an opening 113 that is formed through the connector housing 11, in particular through a wall of the coupling part 22 and a wall of the cover part 23. Preferably the exterior wall of the female fitting 111 fits in relatively snug relation to the walls of the connector housing 11 which bound the opening 113 to minimize and preferably to prevent leakage of grease, moisture, and/or other material therebetween. A flange 114 circumscribing the interior end of the female fitting 111 prevents the female fitting from being pulled through the opening 113 to the environment external of the connector housing 11; therefore, the female fitting 111 is inserted into the opening 113 from the inside, i.e., the hollow interior 27, of the connector housing 11 prior to installation of the contact carrier module 24. The male fitting 112 fits into the female fitting 111 in the manner illustrated in FIG. 13. Glue or other adhesive preferably is applied to the interface 115 between the exterior wall of the male fitting 112 and the confronting interior wall of the female fitting 111. A flange 116 at the outside end of the male fitting 112 prevents the male fitting from being fully inserted into the female fitting and opening 113. The flange 116 also may provide a sealing function to block dirt, grease, moisture and/or other material from access to the opening 113 and/or female fitting 111 by direct engagement with the external surface 117 of the connector housing 11. A cover 120 is connected to the male fitting 112 via a living hinge 121. The male fitting 112, cover 120, and living hinge 121 may be molded as a single part using conventional plastic injection molding techniques or some other technique. The female fitting 111 and male fitting 112 may be formed of plastic, rubber, other polymer material, etc.

The cover 120 includes an insert 122 that fits into the stepped interior 123 of the male fitting 112. Protrusions 124 on the insert 122 resiliently lock the insert in the opening 123 by confronting engagement with the step 125 when the cover is closed. Preferably the cover 120 is formed of resiliently flexible material, and the insert 122 tends to compress slightly as it is pressed into the opening 123 to seal closed such opening. A flange-like cap 126 cooperates with the flange 116 of the male fitting 112 to block dirt, moisture and/or other material from entering the area of the opening 123. The flange 126 also facilitates manual grasping thereof to pry the cover 120 away from the flange 116 to remove the insert 122 from the opening 123.

The port 110 described above is an example of a useful and effective port to provide access to the interior 27 of the connector housing 11. However, it will be appreciated that other types of ports also may be used in accordance with the present invention to provide the same or similar functions to the port described in detail above.

In the present invention preferably the entire interior 27 of the connector housing is filled with grease 102. Also, the grease preferably is water repellant or at least water resistant. Therefore, the possibility that water may enter the connector through some leak area is substantially reduced because there is no space in the connector for the water. Providing the accessible port enables the grease to be maintained at a substantially full level or such other level as may be desired. The grease also may be used to reduce the possibility of arcing, especially in the female connector housing 11, and/or to facilitate sliding of contacts relative to each other in the female connector assembly. The fluid tight seals described above, e.g., by cooperation of the contact module 24 with the connector housing 11 and by the cable holding mechanism 13, not only work to keep out moisture but also retain the grease in the space 27 in the connector assembly 10.

In environments where food processing is performed it is important that sources of bacteria and havens for bacteria growth be avoided, preferably eliminated. Such environments frequently are washed with water and sometimes with various chemicals, detergents, etc., to maintain a high level of cleanliness. The water light characteristics of the electrical connectors of the invention when standing alone and when interconnected with another electrical connector according to the invention, helps to enable the connector(s) to withstand damage to the structure and operation from such washing.

Additionally, a type of grease used in the electrical connector of the invention is a material that has anti-bacterial characteristics. Therefore, the grease will tend to prevent growth and accumulation of bacteria within the electrical connector. An exemplary grease useful for such purpose is that which is a silicone compound. A form of such grease is that known as a dimethyl silicone compound. A particular dimethyl silicone compound useful in the invention is sold by Dow Coming Corporation under the identification Dow Coming 111 Valve Lubricant & Sealant. The grease also preferably has characteristics of being unaffected by water, thus being water resistent or water proof. Therefore, the grease will tend not to degrade when in contact with water and also by filling or substantially filling the otherwise vacant space in the connector housing 11 (11*m*) with such grease, entry of water or moisture is prevented supplemental to the various sealing mechanisms used in the electrical connector. The grease also may provide a lubricating effect to facilitate sliding engagement of contacts with each other; and the grease preferably has arc suppression characteristics, for example, being electrically non-conductive material. The grease preferably is non-toxic to humans. While one form of grease is described here, other materials that have one or more equivalent characteristics to those described may be substituted in the present invention.

Another material which may be used in the connector housing instead of the mentioned grease is an industrial encapsulant, such as that sold under the trademark Waterguard™ by Waterguard Industries, Houston, Tex. Such material may be in the form of a hygroscopic dielectric gel. The encapsulant material can be placed in the connector housing, and it provides electrical properties, such as, for example, electrical resistivity greater than $6.52\times10^{10}$, dielectric constant 2.92, dissipation factor less than 0.002, and voltage breakdown greater than 10,000 v/cm characteristics. The Waterguard encapsulant material may be applied into the connector housing through a port such as port 110. The encapsulant material may fill the space in the housing not otherwise occupied; and it forms a permanent seal protecting against water and also eliminates moisture which may have been present when applied into the housing. The encapsulant also may act as a preserver and insulator from future water intrusion preventing water damage to wiring, contacts, and other electrical components that may be in the housing.

Features of the mentioned encapsulant which are advantageous are those related to application and those related to function. The material is non-toxic, odorless, has long shelf life, and wipes off hands with a paper towel or rag, which features facilitate and enhance the ability to use, i.e., to apply the material, for the connector of the invention. The material has the above-mentioned electrical characteristics to enhance operation of the connector. Additionally, the material being non-toxic and odorless enhances utility for connectors intended for use in the food processing industry. The reducing of moisture in the connector also reduces the tendency for bacteria growth and accumulation, which further enhances utility for connectors used in the food processing industry. While one form of encapsulant material is described here, other materials that have one or more equivalent characteristics to those described may be substituted in the present invention.

Briefly referring to FIG. 14, a cable holding mechanism 130 according to the invention is shown in use with the face plate 131, for example, of an electrical junction box, electrical panel, etc. The cable holding mechanism 130 is substantially the same as the cable holding mechanism 13 described above, and in FIG. 14 parts corresponding to those described above with reference to FIGS. 1–4, for example, are identified by the same reference numerals with the suffix "p".

The cable holding mechanism 130 includes a coupling part 22*p* and a holder 60*p* for holding the cable 12 securely relative to the face plate 131 so as to prevent pulling the cable out from the cable holding mechanism in the direction of the arrow 132. The holding part 60*p* includes a clip 40*p*, grommet 61*p*, ferrule 62*p* and nut 63*p*. As was described above, the parts of the holder 60 are placed on the cable 12, the cable is placed through the coupling part 22*p*, and the nut 63*p* is tightened on the thread of the coupling part thereby to secure the cable and to provide a fluid tight seal. The coupling part 22*p* has a threaded extension 133 that passes through an opening 134 in the face plate 131 and also has a flange 135 to prevent the coupling part from being pulled through the opening 134. A nut or other fastener 136 can be tightened on the threaded extension 133 of the coupling part 22*p* to secure the coupling part to the face plate 131. If desired, sealing material may be placed between the flange 135, face plate 131 and nut 136 to seal the opening 134.

Thus, it will be appreciated that the cable holding mechanism 13, 130 of the invention can be used to hold cables and various other devices together in the above-described manner.

We claim:

1. Apparatus for holding an elongate member relative to a device, comprising a retainer for at least partially circumscribing at least a portion of said elongate member, said elongate member comprising an electrical cable having at least one electrical conductor, said retainer including means for engaging said elongate member to prevent relative axial movement of said retainer and said elongate member, receiving means positionally associated with said device for receiving at least a part of said retainer and at least a part of said elongate member, said receiving means including means for preventing such loosening of said retainer relative to said elongate member that would permit substantial relative axial movement of said retainer and elongate member, a holder for blocking withdrawal of said retainer from said receiving means in at least one direction, an electrical connector comprising a connector housing and means for making electrical connections, said means for making electrical connections being connected to at least one electrical conductor of said cable and being connectable to further means for making electrical connections, at least one signal conductor located at least partly in said housing for making connections, and a port for providing access to the interior of said housing to permit the delivery of fluidic material into said housing, said fluidic material having water resistant and anti-bacterial qualities.

2. The apparatus of claim 1, said retainer comprising plural segments and a support, said segments being positioned on said support in spaced relation to each other to engage said elongate member.

3. The apparatus of claim 2, said segments being of a size, shape and relative position to deform said elongate member when said support is compressed about at least a portion of said elongate member, and said segments being relatively smooth to avoid breaking said elongate member.

4. The apparatus of claim 2, wherein said support is resilient, said segments comprise members spaced away from each other such that they do not engage each other upon compressing of said support about said elongate member by interaction with said means for preventing.

5. The apparatus of claim 1, said receiving means comprising a hollow tubular member.

6. The apparatus of claim 5, said hollow tubular member having an external thread, and said holder comprising a nut secured to said thread.

7. The apparatus of claim 1, said means for preventing comprising a tapered wall to cooperate with said retainer to compress said retainer into engagement with said elongate member.

8. The apparatus of claim 7, said retainer comprising plural segments and a support, said segments being positioned on said support in spaced relation to each other to engage said elongate member;

said segments being of a size, shape and relative position to deform said elongate member when said support is compressed about at least a portion of said elongate member, and said segments being relatively smooth to avoid breaking said elongate member;

wherein said support is resilient, said segments comprise flange-like members spaced away from each other such that they do not engage each other upon compressing of said support about said elongate member by interaction with said means for preventing.

9. The apparatus of claim 1, said means for preventing comprising a wall, and said retainer comprising a clip-like member having a central opening for receiving said elongate member, a generally hollow partial cylinder support having a path allowing compression of said support to reduce the effective diameter thereof as the support is compressed about said elongate member, and said support having a tapered exterior surface for collaboration with said receiving means, whereby said support is compressed upon insertion into said receiving means.

10. The apparatus of claim 9, said retainer comprising plural segments and a support, said segments being positioned on said support in spaced relation to each other to engage said elongate member; and said segments being of a size, shape and relative position to deform said elongate member when said support is compressed about at least a portion of said elongate member, and said segments being relatively smooth to avoid breaking said elongate member.

11. The apparatus of claim 1, said holder comprising a resilient grommet.

12. The apparatus of claim 11, said grommet having a truncated annular leading surface for engagement with said receiving means to provide a fluid tight seal therewith, and said grommet having a hollow passage through the interior thereof for passage of said elongate member therethrough.

13. The apparatus of claim 11, said grommet comprising a resilient material, at least part of said grommet being positionable in said receiving means, and further comprising a relatively rigid ferrule engaged with a surface of said grommet for preventing extruding of said grommet beyond said ferrule as said grommet is pressed into said receiving means.

14. The apparatus of claim 13, said holder further comprising a fastener for pressing against said ferrule to urge said grommet into said receiving means.

15. The apparatus of claim 11, wherein said elongate member comprises a cable passing through said grommet and wherein smooth bending of said cable is provided where the cable exits the grommet.

16. The apparatus of claim 15, said grommet further comprising an elongate boot for circumscribing at least part of said cable to control the bending of said cable, said holder further comprising a fastener holding said grommet to said receiving means, and at least part of said boot and cable extend beyond said fastener.

17. The apparatus of claim 1, further comprising an encapsulant material in said connector housing.

18. The apparatus of claim 17, said encapsulant material comprising an hygroscopic dielectric gel.

19. An electrical assembly, comprising a housing, an opening into said housing, a cable positioned relative to said housing and at least partly located in said opening means, and retention means for retaining said cable relative to said housing, said retention means including clip means for circumscribing at least a portion of said cable and deforming said circumscribed portion of said cable to grasp said cable, grommet means for frictionally engaging said cable to prevent relative movement of said cable and grommet means, and holding means for holding said grommet means in at least part of said opening while said grommet means frictionally holds said cable, said grommet means being located between said clip means and at least part of said holding means, and a port for providing access to the interior of said housing to permit the delivery of grease into said housing.

20. A connector, comprising a housing, signal conducting means at least partly in said housing for making connections, grease means in said housing for resisting growth of bacteria, said grease means having water resistant and anti-bacterial qualities, and port means for providing access to the interior of said housing to permit delivery of said grease means into said housing.

21. The connector of claim 20, wherein said grease means at least substantially fills portions of said housing not otherwise occupied.

22. The connector of claim 21, said grease means further having characteristics of preventing electrical arcing in the housing upon separation of electrical contacts therein and of lubricating connections between such contacts.

23. The connector of claim 26, said grease means comprising a silicone compound.

24. The connector of claim 23, said silicone compound comprising dimethyl silicone.

25. A connector, comprising a housing, signal conducting means at least partly in said housing for making connections, and port means for providing access to the interior of said housing to permit the delivery of fluidic material into said housing, said fluidic material having water repelling and anti-bacterial qualities.

26. A method of reducing growth of bacteria in a connector including a housing, a signal conducting means at least partly in said housing, and a port for providing access to the interior of the housing, comprising placing an anti-bacterial material in said housing via said port, said placing comprising placing at least some of said material in proximity to at least part of said signal conducting means.

27. The method of claim 26, said placing comprising placing a silicone compound in said housing.

28. The method of claim 27, said placing a silicone compound comprising placing a dimethyl silicone compound.

29. The method of claim 26, said placing comprising substantially filling space in said housing not otherwise occupied.

30. The method of claim 26, said placing comprising placing an hygroscopic material in said housing.

* * * * *